US007003972B2

(12) United States Patent
Eom et al.

(10) Patent No.: US 7,003,972 B2
(45) Date of Patent: Feb. 28, 2006

(54) INDOOR UNIT FOR AIR CONDITIONER

(75) Inventors: Nam Seob Eom, Seoul (KR); Dae Hyoun No, Gyeongsangnam-do (KR); Sung Woo Song, Busan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/756,411

(22) Filed: Jan. 14, 2004

(65) Prior Publication Data

US 2005/0109053 A1 May 26, 2005

(30) Foreign Application Priority Data

Nov. 24, 2003 (KR) ..... 10-2003-0083542
Nov. 28, 2003 (KR) ..... 10-2003-0085405
Dec. 19, 2003 (KR) ..... 10-2003-0093631
Dec. 19, 2003 (KR) ..... 10-2003-0093632

(51) Int. Cl.
*F25D 21/14* (2006.01)

(52) U.S. Cl. ..... 62/285; 62/291

(58) Field of Classification Search ..... 62/285, 62/288, 290, 291; 165/127, 150, 179
See application file for complete search history.

(56) References Cited

U.S. PATENT DOCUMENTS 4,679,405 A * 7/1987 Mitchell et al. ..... 62/285
4,783,971 A * 11/1988 Alba ..... 62/291
5,207,074 A * 5/1993 Cox et al. ..... 62/285
6,240,740 B1 * 6/2001 Endo et al. ..... 62/285

* cited by examiner

*Primary Examiner*—Melvin Jones
(74) *Attorney, Agent, or Firm*—McKenna Long & Aldridge, LLP

(57) ABSTRACT

Disclosed is an indoor unit for an air conditioner to smoothly drain condensed water to the outside regardless of an installation state of the indoor unit. The indoor unit includes: a heat exchanger for performing heat exchange; a drain pan for collecting and draining condensed water generated in the heat exchanger; and two or more drain parts formed in the drain pan and through which the condensed water is drained.

23 Claims, 12 Drawing Sheets

INDOOR UNIT FOR AIR CONDITIONER

BACKGROUND OF THE INVENTION

1. Field of the Invention

The present invention relates to an air conditioner, and more particularly, to an indoor unit for an air conditioner in which the indoor unit is installed standing on its head with ease. Further, this invention is directed toward an indoor unit for an air conditioner in which drain problem of condensed water generated in the course of heat exchange in the indoor unit is solved to thereby enhance the usage convenience.

2. Description of the Related Art

In general, air conditioner is a cooling/heating apparatus installed in an indoor space such as office, home or the like, for cooling or heating the indoor space. Also, air conditioner is an apparatus for changing air status through a series of cooling cycle made by compressor, condenser, expander and evaporator.

The air conditioner includes an outdoor unit installed at an outdoor space and an indoor unit installed at an inner space of a building. The outdoor unit is provided with a condenser and a compressor, and the indoor unit is provided with an evaporator. Between the indoor unit and the outdoor unit, a refrigerant tube through which liquid or vapor refrigerant is circulated is installed.

The indoor unit is shaped in a rectangular bar and forms its appearance by a front panel, a side panel, a rear panel and an upper panel. A lower face of the indoor unit is opened to form a suction inlet and an upper surface of the indoor unit is penetrated to form an air outlet. In the meanwhile, a connection duct may be further installed in the suction inlet and the discharge outlet to connect the indoor unit with a space for air conditioning.

Inside the indoor unit is installed a barrier partitioning the inner space of the indoor unit into an upper portion and a lower portion. Below the barrier is installed a fan housing accommodating an indoor fan for generating a forced flow of air. Below the fan housing is installed an indoor heat exchanger. The indoor heat exchanger allows for heat exchange between refrigerant flowing through the refrigerant tube and air inflowed/outflowed by indoor fan. Below the indoor heat exchanger is installed a drain pan. The drain pan allows condensed water generated during an operation of the indoor heat exchanger to be collected and drained to the outside.

The drain pan is provided with a drain part protruded. The drain part is installed exposed to the outside and allows the condensed water staying in the drain pan to be drained to the outside. At the front panel, refrigerant tube through which refrigerant inflow or outflows and a plurality of penetration holes through which the drain part of the drain pan passes for connection with the exterior of the indoor unit are formed.

The conventional indoor unit has the following drawbacks. That is, when it is necessary to install the indoor unit in a standing state on its head depending on a change in the place where the indoor unit is mounted, and a change in the width and length of the place where the indoor unit is mounted, proper correspondence is impossible. In detail, when the inner door is mounted on the relatively high ceiling or the like in a standing state on its head, drain pan is positioned at the uppermost place of the indoor unit and indoor heat exchanger is positioned below the drain pan, which results in difficulty in collecting condensed water.

Also, in case the indoor unit is manufactured in a structure that allows only a standing installation on its head, it can be used only upon the standing installation on its head. Accordingly, a user fails to selectively install the indoor unit in a standing state on its head or a standing straight state. The drain problem of the condensed water occurs identically even in a lying installation as well as in the standing straight installation and the standing installation on its head.

Finally, due to this necessity, it is strongly required to provide a construction allowing the installation of the indoor unit in a desired direction. Especially, upon considering a tendency that the indoor space is narrowed and used densely in recent years, it is a strongly requested function to enable various alterations of the installation position of the indoor unit.

SUMMARY OF THE INVENTION

Accordingly, the present invention is directed to an indoor unit for an air conditioner that substantially obviates one or more problems due to limitations and disadvantages of the related art.

It is an object of the present invention to provide an indoor unit for an air conditioner in which it is allowed to alter the installation state of the indoor heat exchanger and the drain pan as necessary so that the installation direction of the indoor unit can be simply changed by a user.

It is another object of the present invention to provide an indoor unit for an air conditioner in which when the installation direction of the indoor unit is changed, condensed water can be rapidly drained regardless of the moving direction of the condensed water due to gravity. In other words, like when the indoor unit is installed in a straight standing state, a standing state on its head, or a lying state, although the indoor unit is installed in any direction, the indoor unit allows the condensed water essentially generated during operation of the indoor heat exchanger to be completely drained to the outside, thereby capable of actively responding to consumer's taste.

It is a further object to provide an indoor unit for an air conditioner that allows the indoor unit to be installed regardless of the installation direction through a simply change of the shape and construction without complicated change of the construction, thereby reducing the manufacturing costs of the indoor unit and enhancing the use convenience.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided an indoor unit for an air conditioner, comprising: a heat exchanger for performing heat exchange; a drain pan for collecting and draining condensed water generated in the heat exchanger; and two or more drain parts formed in the drain pan and through which the condensed water is drained.

In an aspect of the present invention, there is provided an indoor unit for an air conditioner, comprising: a heat exchanger for performing heat exchange; a drain pan for collecting and draining condensed water generated in the heat exchanger; a drain part formed in the drain pan and through which the condensed water is drained; and an inclined surface formed at a bottom surface of the drain pan and inclined in at least one direction such that the condensed water is smoothly drained.

In another aspect of the present invention, there is provided an indoor unit for an air conditioner, comprising: an indoor heat exchanger for performing heat exchange; a lower drain pan for collecting and draining condensed water generated in the indoor heat exchanger, at a lower side of the indoor heat exchanger; a side drain pan for collecting and draining condensed water generated in the indoor heat exchanger, at a side portion of the indoor heat exchanger; and a drain part formed in the lower drain pan and/or the side drain pan and through which the condensed water is drained.

In a further aspect of the present invention, there is provided an indoor unit for an air conditioner, comprising: a heat exchanger for performing heat exchange; a drain pan for collecting and draining condensed water generated in the heat exchanger; two or more drain parts formed in the drain pan and through which the condensed water is drained; and a front panel provided with a drain hole through which the drain part is penetrated, the front panel having a varied installation position.

According to the present invention, drainage problem of condensed water indicated as a problem of the conventional indoor unit can be solved. Also, in any of cases where the indoor unit is installed in a straight standing state, in a standing state on its head, or in a lying state, drainage problem of condensed water is not generated and the condensed water can be drained to the outside smoothly.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. It will be apparent to those skilled in the art that various modifications and variations can be made in the present invention. Thus, it is intended that the present invention covers the modifications and variations of this invention provided they come within the scope of the appended claims and their equivalents.

Figure 1:
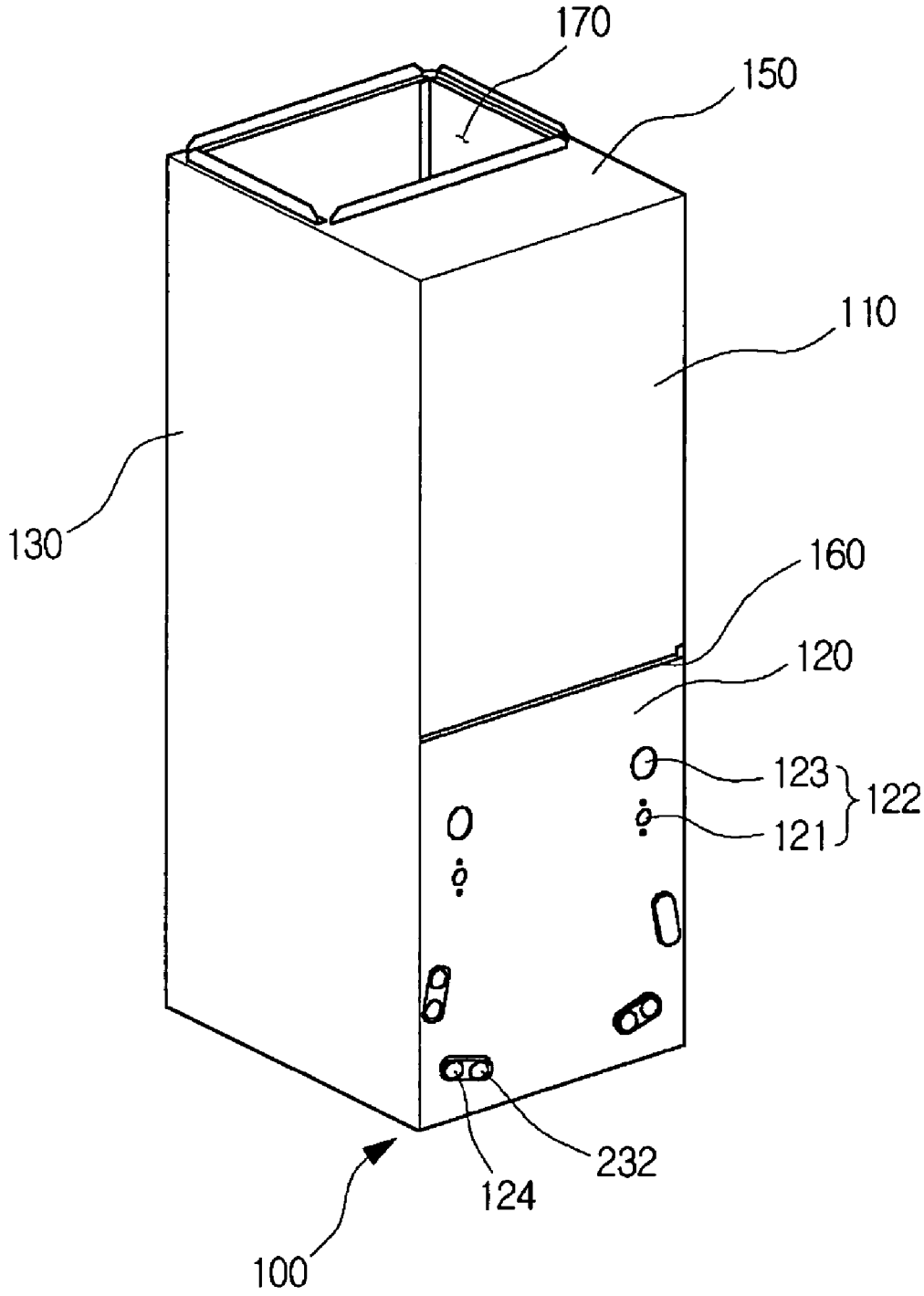
FIG. 1 is a perspective view illustrating an appearance of an indoor unit for an air conditioner according to a preferred embodiment of the present invention.
Figure 2:
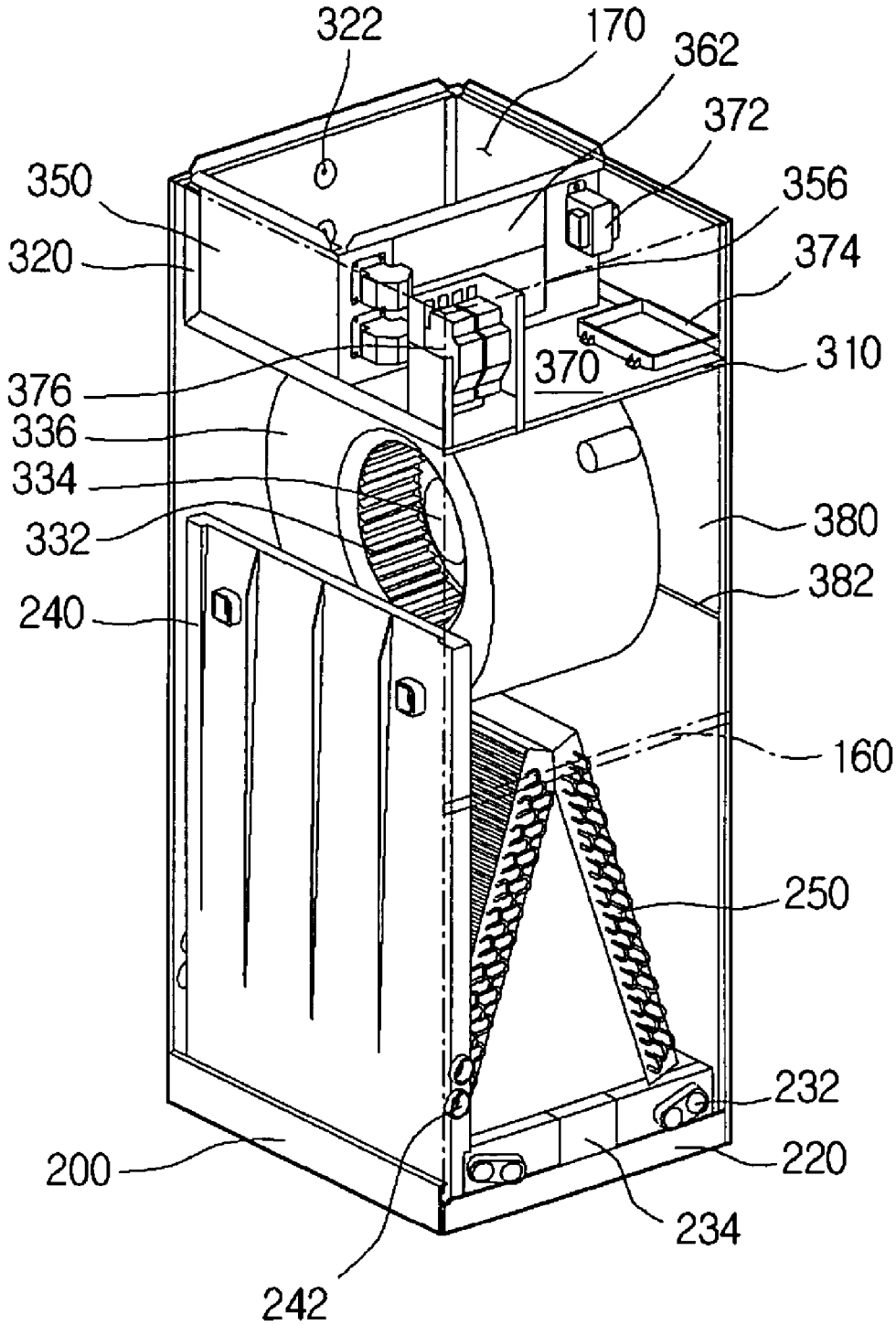
FIG. 2 is an inner perspective view of an indoor unit for an air conditioner for an air conditioner according to an embodiment of the present invention.
Figure 3:
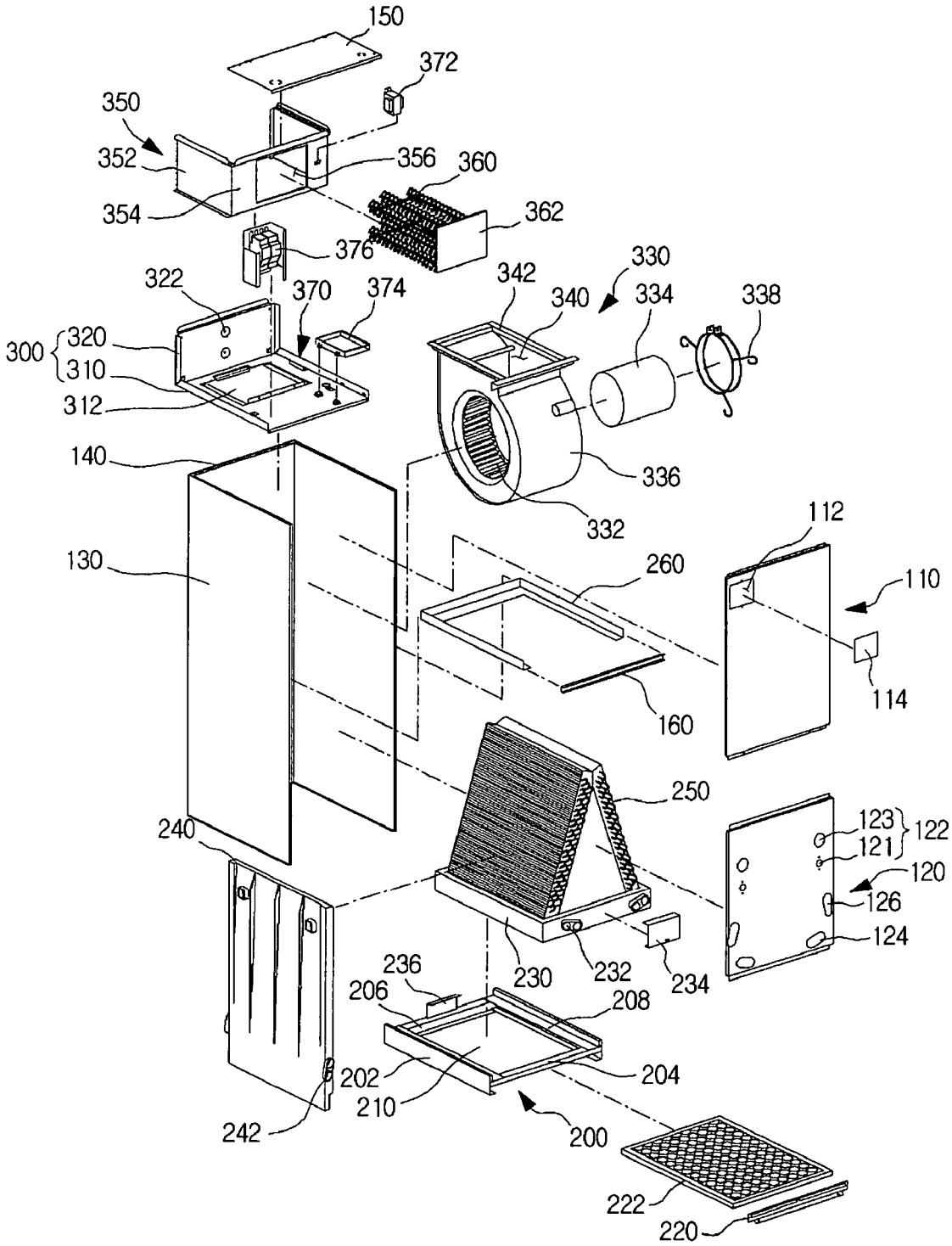
FIG. 3 is a disassembled perspective view of an indoor unit for an air conditioner according to the present invention.

FIG. 1 is a perspective view illustrating an appearance of an indoor unit for an air conditioner according to a preferred embodiment of the present invention, FIG. 2 is an inner perspective view of an indoor unit for an air conditioner for an air conditioner according to an embodiment of the present invention, and FIG. 3 is a disassembled perspective view of an indoor unit for an air conditioner according to the present invention.

Referring to FIGS. 1 to 3, an indoor unit 100 is approximately shaped in a rectangular box, and generally includes a cabinet part forming appearance of the indoor unit 100, a heat exchange part for performing heat exchange, a condensed water flow passage guide part through which condensed water is drained, a blower part for forcibly blowing air, and an electronic equipment part in which electronic parts are installed.

In detail, the cabinet part is configured to include front panels 110, 120 forming a front appearance of the indoor unit 100, side panels 130 forming a side appearance, a rear panel 140 forming a rear appearance, an upper panel 150 forming an upper appearance, and a lower frame 200, thereby forming an entire appearance of the indoor unit 100. The front panels 110 and 120 are divided into an upper portion and a lower portion, and consists of a front upper panel 110 placed at an upper side and a front lower panel 120 disposed below the front upper panel 110. A panel holder 160 is interposed between the front upper panel 110 and the front lower panel to closely contact the lower end of the front upper panel 110 and the upper end of the front lower panel 120 to the side panel 130. Alternatively, the side panel 130 and the rear panel 140 may be formed in an integral type so as to save the manufacturing costs.

In detail, at an upper left side of the front upper panel, a switch exposing hole 112 is formed. The switch exposing hole 112 is approximately shaped in a rectangle and configured to expose a power switch 376 to the outside. Also, the switch exposing hole 112 can be closed by a shielding plate 114 having a corresponding size to the switch exposing hole 112 when the air conditioner is not used.

In detail, the front lower panel is provided at left and right sides thereof with tube holes 122 through which a refrigerant tube communicating with an indoor heat exchanger 250 is penetrated. Each of the tube holes 122 consists of a high pressure tube hole 121 through which a high pressure tube for flow of refrigerant with a higher pressure is penetrated, and a low pressure tube hole 123 through which a low pressure tube for flow of refrigerant with a lower pressure is penetrated. A drain hole 124 through which a drain part 232 of a drain pan 230 is exposed to is also formed in the front lower panel 120. Further, a side drain hole 126 through which a side drain part 242 of a side drain pan 240 is exposed to, is formed above the drain hole 124.

In detail, at upper and lower ends of the front lower panel 120, bent ends 128 and 129 are formed symmetric with each other. In other words, an upper end of the front lower panel 120 is first bent reward by a predetermined portion and then again bent upward to form the upper bent end 128, and a lower end of the front lower panel 120 is first bent reward by a predetermined portion and then again bent to form the lower bent end 129. Thus, since the front lower panel 120 is constructed such that their upper and lower ends are symmetric with each other, it can be assembled with surrounding parts with ease even when the indoor unit is installed in a standing state on its head. The shape of the front lower panel 120 can be apparently understood by the perspective view of the front lower panel shown in FIG. 5.

In detail, the upper panel 150 forms the appearance of a front half of an upper face of the indoor unit 100. The remaining rear half of the upper face of the upper panel 150 is opened to form a discharge outlet 170. Indoor air of the indoor unit is discharged to the outside through the discharge outlet 170.

In detail, at a lower side of the side panel 130, a lower frame 200 is formed. The lower frame 200 includes a side frame part 202 extending in a front and rear direction and fixed to the lower side of the side panel 130, a front end frame part 204 connecting the front ends of the side frame parts 202, and a rear frame part 206 connecting the rear ends of the side frame parts 202. At an inner space of the lower frame 200 defined by the frame parts 202, 204 and 206, a rectangular suction inlet 210 is formed to guide air inflowed from the outside to the inside of the indoor unit 100. Also, at an upper end portion of the side frame part 202, a pan sliding part 208 protruded in a side direction is further formed. In other words, the pan sliding part 208 is protruded inwardly from the side frame part 202 by a predetermined length and extended in the front and rear direction. The drain pan 230 and the indoor heat exchanger 250 are supported on an upper surface of the pan sliding part 208, and the drain pan 230 is placed on the pan sliding part 208 and is slidable in the front and rear direction. Also, a filter cover 220 is formed on a front surface of the lower frame 200, and a rectangular air filter 222 is fixed to a rear surface of the filter cover 220. Accordingly, if the filter cover 220 is coupled to the front surface of the lower frame 200, the air filter 222 shields the suction inlet 210 so that foreign particles inflowed from the outside are filtered.

Next, construction of the condensed water flow passage guide will be described. On the lower frame, the drain pan 230 is mounted. The drain pan 230 is a portion to collect and drain condensed water generated in the indoor heat exchanger 250. At a front portion of the drain pan 230, a drain part 232 guides the condensed water staying in the drain pan 230 to be drained to the front side. The drain part 232 is exposed to the outside through the drain hole 124 of the front lower panel 120 and guides the drain of condensed water. In the meanwhile, it is desirable that the bottom of the drain pan 230 is partially inclined such that the condensed water staying in the bottom naturally flows to the front end. Alternatively, the bottom of the drain pan 230 is molded in a shape corresponding to the bottom surface of the heat exchanger 250.

Construction of the drain pan 230 will be described in more detail with reference to FIGS. 4 to 8.

Figure 4:
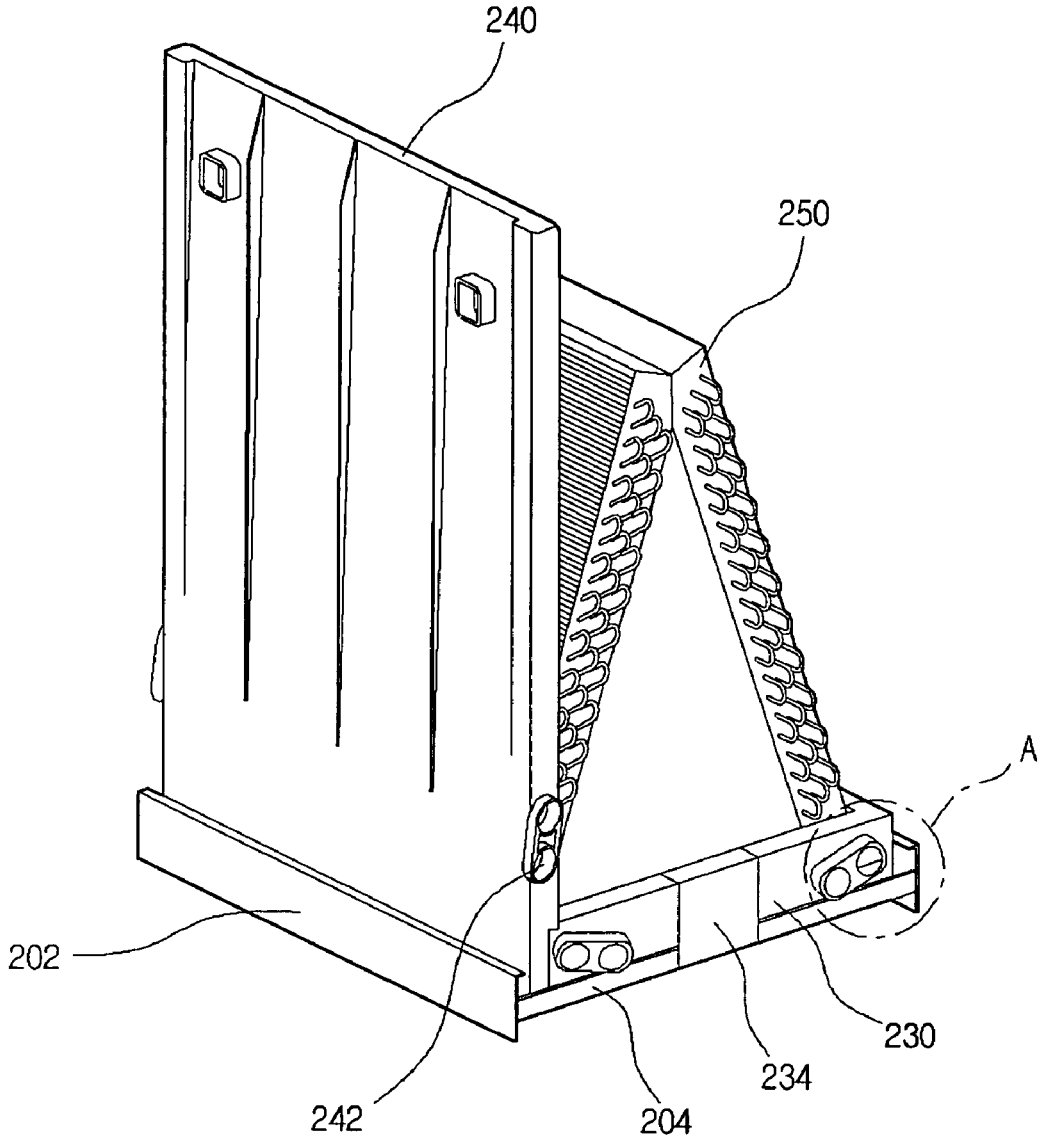
FIG. 4 is a perspective view of a drain assembly according to an embodiment of the present invention.
Figure 5:
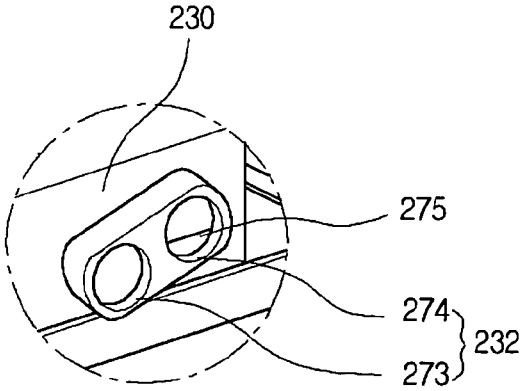
FIG. 5 is a detailed view of the portion "A" of FIG. 4.
Figure 6:
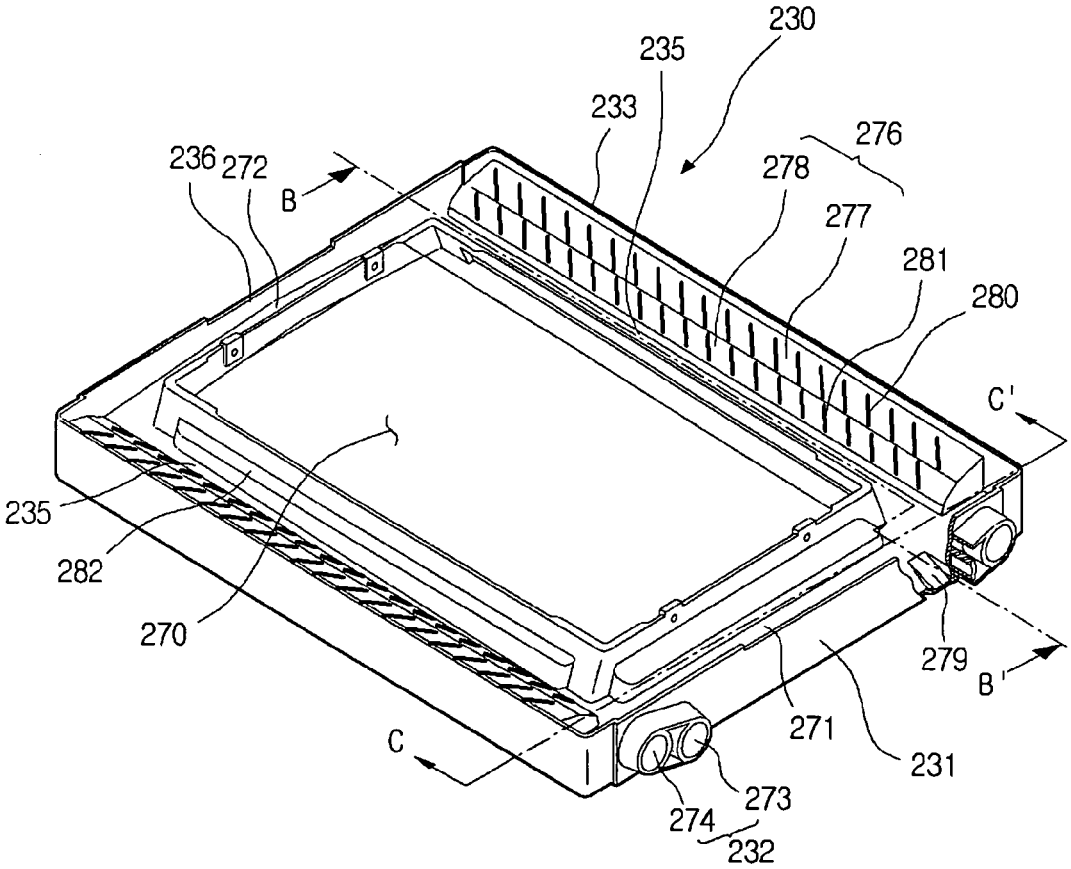
FIG. 6 is a perspective view of a drain pan according to an embodiment of the present invention.
Figure 7:
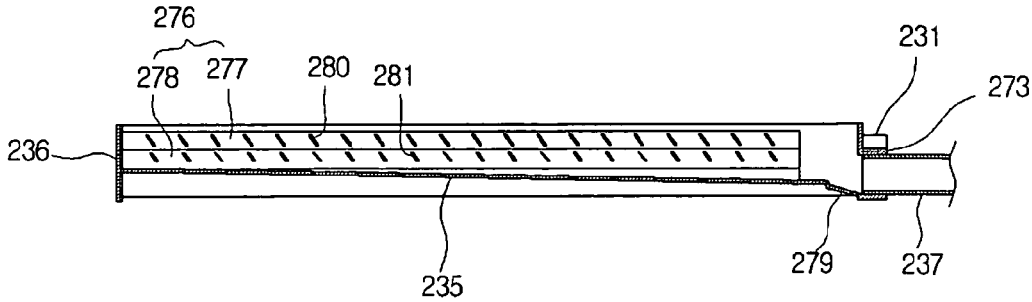
FIG. 7 is a sectional view taken along the line B–B' of FIG. 6.
Figure 8:
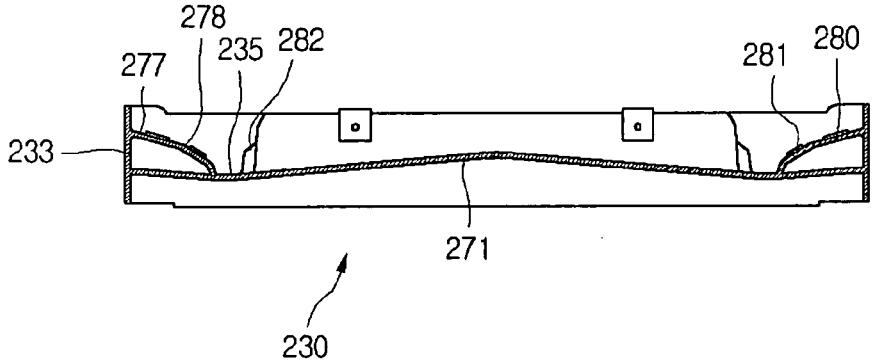
FIG. 8 is a sectional view taken along the line C–C' of FIG. 6.

FIG. 4 is a perspective view of a drain assembly including a drain pan 230 and a side drain pan 240 according to an embodiment of the present invention, FIG. 5 is a detailed view of the portion "A" of FIG. 4, FIG. 6 is a front perspective view of a drain pan, FIG. 7 is a sectional view taken along the line B–B' of FIG. 6, and FIG. 8 is a sectional view taken along the line C–C' of FIG. 6.

The drain pan 230 includes a front end part 231 formed in a left and right direction, a side end part 233 extending rearward from the left and right side ends by a predetermined length, and a rear end part 236 connecting rear ends of the side end part 233 with each other. Inside the drain pan, a drain suction hole 270 through which inflow air passes is formed.

Bottom surfaces formed inside the front end part 231 and the rear end part 246, i.e., front end bottom surface 271 and rear end bottom surface 272 are constructed such that their height is reduced as it goes from their center portions to the right and left directions. Accordingly, condensed water collected in the front end bottom surface 271 and the rear end bottom surface 272 flow down to the left and right sides, is transferred to the front side through a side bottom surface 235 to be described below and finally drained to the outside. Meanwhile, bottom surfaces of corners of the left and right sides of the front end part 231, i.e., left and right side end parts of the front end bottom surface 271 are inclined inward. Accordingly, condensed water collected in these corners flows down in an inward direction and is easily drained to the outside through the drain part 232. The shape of the front end bottom surface 271 would be apparently understood by the sectional view of FIG. 8.

In the meanwhile, the side bottom surface 235 can be constructed such that its rear end has a greater width than the front end. By this construction, when condensed water is moved to the front side, it is possible to gradually increase the flow velocity as it goes from the rear end to the front end.

The drain part 232 includes a main drain part 273 formed penetrating the front end of the drain pan 230, and an auxiliary drain part 274 formed penetrating a point of the front end of the drain pan 230 above main drain part 273. The auxiliary drain part 274 is to drain condensed water, which is not still drain through the main drain part 273.

In the meanwhile, inside the auxiliary drain part 274, a shield jaw 275 may be further formed. The shield jaw 275 is configured to shield a lower half of the auxiliary drain part 274. Accordingly, condensed water leveled below a critical water level is all drained through the main drain part 273 not through the auxiliary drain part 274. So, the height of the shield jaw 275 can be elevated up to a height corresponding to the height of the main drain part 273.

An inclined surface 276 is formed in an inward direction of the side end part 233 of the drain pan 230. In other words, the inclined surface 276 is formed such that the upper face of the side end part 233 is inclined inward to thereby guide the flow of condensed water. The inclined surface 276 is formed in a dual structure. In detail, the inclined surface 276 includes a first inclined surface 277 having a slope in an inward direction from the uppermost point, and a second inclined surface 278 having a different slope than the first inclined surface 277 starting from the lower end of the first inclined surface 277. The second inclined surface 278 is formed to have a higher slope than the first inclined surface. Thus, the dual structure of the inclined surface 276 is to smoothly contact the drain pan 230 with the bottom surface of the heat exchanger 250 mounted on the drain pan 230.

In the meanwhile, the side bottom surface 235 connected with the lower end of the second inclined surface 278 is configured such that its rear end has a higher constant slope than the front end. In other words, the side bottom surface 235 is formed, inclined toward the front side such that the condensed water collected in the side bottom surface 235 is guided to the front end part easily. Also, on the front end part of the side bottom surface 235, a depressed part 279 further downwardly inclined than the front end of the side bottom surface 235 is formed. The main drain part 273 is formed at the front end of the depressed part 279. Accordingly, in case the drain hose 237 is coupled to the main drain part 273, the drainage of the condensed water is not hindered due to the thickness of the drain hose 237. In other words, since the inner lower surface is leveled lower than the front end part of the side bottom surface 235, the thickness of the drain hose 237 does not hinder the condensed water from staying in the side bottom surface 235. This operation can be apparently understood by the sectional view of FIG. 7.

In the meanwhile, on the first and second inclined surfaces 277 and 278, first and second inclined protrusions 280 and 281 are respectively formed. In detail, the first inclined protrusion 280 is protruded upward from the first inclined surface 277 to guide the transfer of condensed water and is configured to include a plurality of protrusions arranged apart by a predetermined interval from one another in a left and right direction. The second inclined protrusion 281 is protruded upward from the second inclined surface 278 to guide the transfer of condensed water and is configured to include a plurality of protrusions arranged apart by a predetermined interval corresponding to the interval of the first inclined protrusions from one another. Alternatively, the first inclined protrusion 280 and the second inclined protrusion 281 are formed in an across direction each other, thereby making the flow of condensed water easier.

Also, at edges of the drain suction hole 270, a suction edge 282 is formed. The suction edge 282 is protruded upward from the bottom surfaces 271, 235 and 272. In particular, the suction edge 282 corresponding to the left and right side ends of the front end part 231 is made in a dual structure to prevent the drain pan 230 from being curved or fractured.

Also, at the front end part and the rear end part of the drain pan 230, a pan fixing member 234, 236 for fixing the drain pan 230 to the lower frame 200 is provided. In detail, at the front end of the drain pan 230, a front end fixing member 234 is detachably provided such that the front end part of the drain pan 230 is coupled with the front frame part 204 each other. Also, at the rear end part of the drain pan 230, a rear end fixing member 236 is provided such that the drain pan 230 is coupled with the rear frame part 206 each other. The rear end fixing member 236 may be molded integrally with the rear frame part 206.

Also, at an upper side of the left side end of the drain pan 230, a side drain pan 240 is further provided. The side drain pan 240 is made at a height corresponding to the height of the indoor heat exchanger 250 to collect condensed water dropped due to gravity when the indoor unit is installed in a lying state. At a lower end part of the side drain pan 240, a side drain part 242 is protruded forward. The side drain part 242 guides the condensed water staying in the side drain pan 240 to be drained to the front side through the side drain hole 126. The side drain pan 240 can be installed at the right side not at the left side, or at both the right and left sides.

Figure 9:
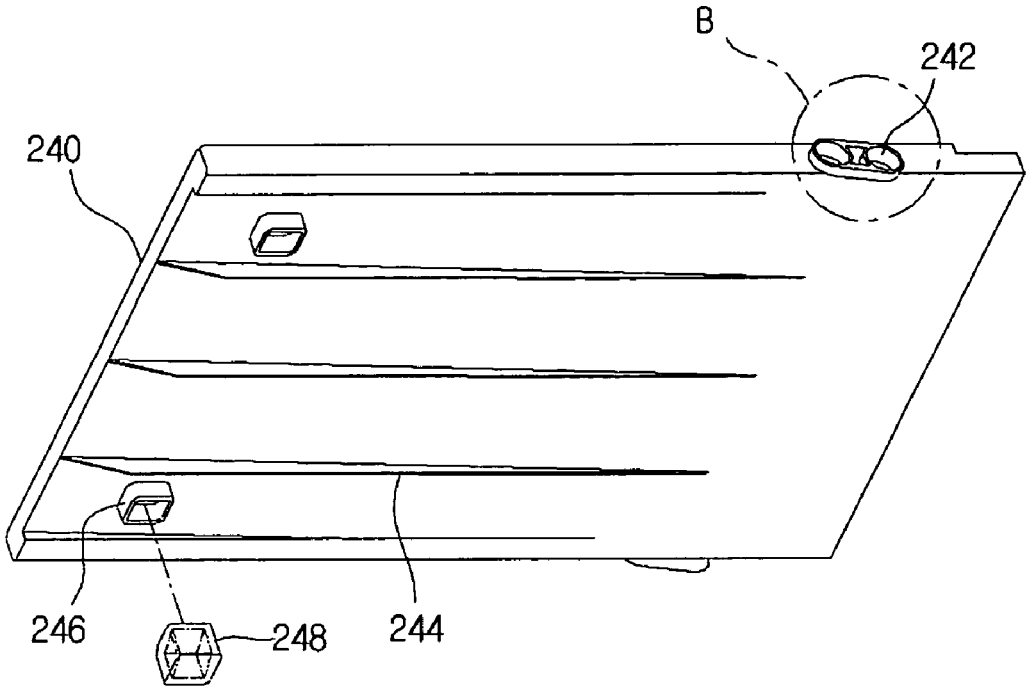
FIG. 9 is a lower perspective view of a side drain pan.
Figure 10:
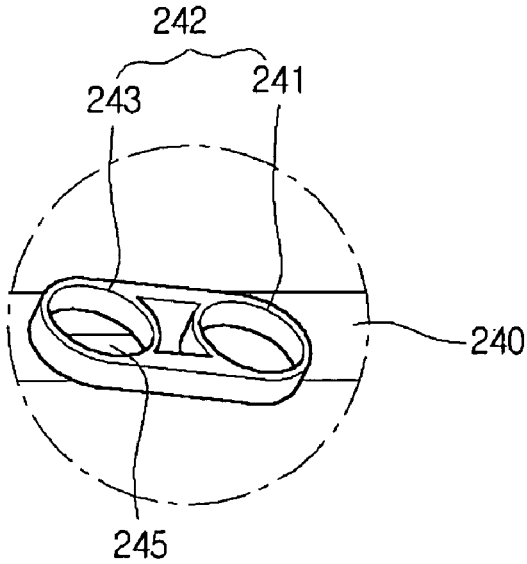
FIG. 10 is a detailed view of the portion 'B' of FIG. 9.
Figure 11:
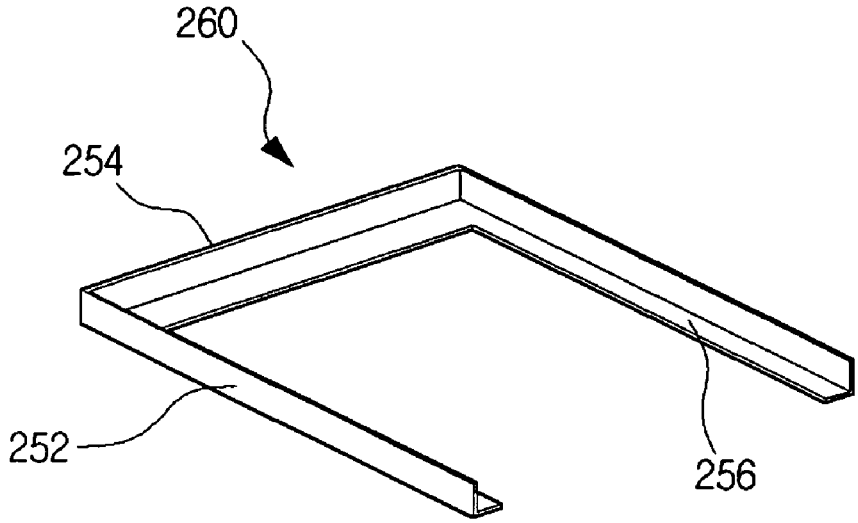
FIG. 11 is a perspective view of a middle frame in an indoor unit for an air conditioner according to the present invention.
Figure 12:
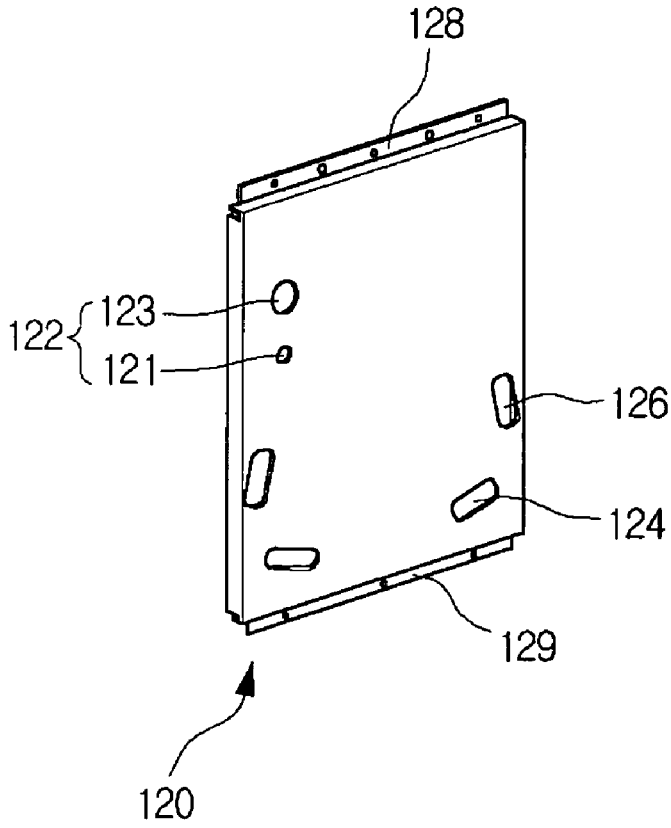
FIG. 12 is a perspective view of a front lower panel in an indoor unit for an air conditioner according to the present invention.

FIG. 9 is a lower perspective view of a side drain pan, and FIG. 10 is a detailed view of the portion 'B' of FIG. 9.

On a lower surface of the side drain pan 240, a plurality of reinforcing ribs 244 are formed. The reinforcing ribs 244 reinforce the strength of the side drain pan 240. The side drain pan 240 of which height is decreased as it goes to the right the inner bottom surface, has an inclined inner bottom surface. Accordingly, the condensed water collected on the upper surface of the side drain pan 240 is collected to the side drain part 242 and drained.

The side drain part 242 includes a side main drain part 241 formed penetrating the front end of the side drain pan 240, and a side auxiliary drain part 243 formed penetrating a point of the front end of the side drain pan 240 above the side main drain part 241. The side auxiliary drain part 243 is to drain the condensed water, which is not still drained through the side main drain part 241. Also, inside the side auxiliary drain part 243, a side shield jaw 245 may be further formed. The side shield jaw 245 is configured to shield a lower half of the side auxiliary drain part 243. Accordingly, condensed water leveled below a critical water level is all drained through the side main drain part 241 not through the side auxiliary drain part 243. So, the height of the side shield jaw 245 can be formed up to a height corresponding to the height of the side main drain part 241.

At a lower side of the side drain pan 240, a support leg serving as support means may be formed. The support legs 246 are respectively formed, protruding with a predetermined height downwardly on the front end part and the rear end part of the side drain pan 240 to thereby one end of the side drain pan 240. Alternatively, an auxiliary leg 248 may be further coupled to the support leg 246. In more detail, the auxiliary leg 248 with a predetermined height is coupled with the support leg 246 formed on the rear end of the side drain pan 240. Accordingly, the side drain pan 240 is partly inclined in a forward direction so that the condensed water on the upper surface flows down to the front side.

Next, construction of the heat exchanger will be described. The indoor heat exchanger 250 is mounted on and integrally with the drain pan 230. The indoor heat exchanger 250 cause heat exchange between refrigerant flowing through the heat exchanger and exterior air, and is constructed in a shape of '^'. The front surface and rear surface of the indoor heat exchanger 250 is shielded to cut off air inflow. The indoor heat exchanger 250 is connected with a refrigerant tube so that expanded refrigerant is inflowed and is then evaporated to cool the surrounding air.

In the meanwhile, a middle frame 260 is installed at a rear side of the panel holder 160. The middle frame 260 includes a side part 252 fixed to the side panel 130, and a rear part 254 fixed to the rear panel 140. On an inner side surface of the middle frame 260, a pan guide 256 is protruded to support the drain pan 230. In detail, when the indoor unit 100 is installed in a standing state on its head, the indoor heat exchanger 250 and the drain pan 230 are placed on the upper side surfaces of the middle frame 260. At this time, the pan guide 256 inwardly protruded from the middle frame 260 by a predetermined width supports the lower surface of the drain pan 230. The middle frame 260 is to guide the position and the installation structure of the indoor heat exchanger 250 when the inventive indoor unit is installed in a standing state on its head. The shape of the middle frame 260 can be apparently understood by the perspective view of the middle frame shown in FIG. 4.

Next, construction of the blower part will be described in detail. The upper frame 300 is installed over and apart by a predetermined distance from the middle frame 260. The upper frame 300 includes a barrier 310 for partitioning an inner space into an upper portion and a lower portion, and a vertical guide part 320 vertically bent upward from a rear end of the barrier 310 and extended. The barrier 310 has a discharge hole 312 for guiding discharge of air forcibly blown from an indoor fan 332 to be described below. A housing assembly 330 is installed below the barrier 310. The housing assembly 330 includes an indoor fan 332 for generating air flow, a fan motor for supplying the indoor fan 332 with a rotational power, and a fan housing 336 for housing the indoor fan 332.

In detail, the fan motor 334 includes a motor mount 338 for the installation of the fan motor on an outer circumference thereof. At an upper end of the fan housing 336, a discharge hole 340 serving as an outlet of air discharged by the indoor fan 332 is formed. Also, along an edge of the discharge hole 340, a housing installation guiding part 342 is further formed. The housing installation guiding part 342 is protruded by a predetermined width outwardly from the edge of the discharge hole 340, and allows the fan housing 336 to be coupled to the barrier 310 by a front and rear sliding operation thereof with a housing installation part (not shown) formed at a lower surface of the barrier 410. As the fan motor 334 operates, the indoor fan 332 rotates so that forcible flow of air may be generated.

In detail, the vertical guide part 320 is formed at a predetermined height corresponding to a height of a discharge guide member 350 to guide air discharged through the discharge hole 312 upward. The vertical guide part 320 includes a heater installation groove 322, which is recessed in a rear direction, for latching a rear end of an electric heater 360. The discharge guide member 350 is to guide air forcibly blown by the indoor fan 332 upward, and includes a side plate 352 and a front plate 354, and is mounted on the discharge hole 312 of the barrier 310. The front plate 354 of the discharge guide member 350 includes a heater installation hole 356 through which the electric heater 360 penetrates. The electric heater 360 generates heat using a power supplied from an exterior to raise air temperature, and is installed inside the discharge guide member 350. In other words, the electric heater 360 is installed inside the discharge outlet 170 formed by the discharge guide member 350 and the vertical guide part 320 to heat air discharged by the indoor fan 332.

At a front end of the electric heater 360, a heater support plate 362 is formed integrally with the electric heater 360. Accordingly, when the heater support plate 362 is fixed to the front plate 354 of the discharge guide member 350 and the rear end of the electric heater 360 is received in the heater installation groove 322 formed on the vertical guide part 320, the installation of the electric heater 360 is completed. The electric heater 360 can be installed selectively depending on a user desire. In case that the electric heater 360 is not installed, the heater installation hole 356 of the discharge guide member 350 can be shielded by a separate shielding plate (not shown).

Next, construction of the electric equipment part will be described in detail. A control box 370 is formed in front of the discharge guide member 350. The control box 370 is provided with a plurality of control parts for controlling the operation of the air conditioner, such as a power transformer 372 or a board 374. A power switch 376 is installed at a left front end of the control box 370. The power switch 376 is exposed to the outside through the switch exposing hole 112. The upper face of the control box 370 is shielded by the upper panel 150.

In the meanwhile, a connection duct (not shown) may be further installed at the suction inlet 210 and the discharge outlet 170. In other words, when the indoor unit 100 is not directly in contact with an indoor space for air conditioning but is installed in a warehouse or the like by a separate part, the connection ducts (not shown) connecting the indoor unit 100 with an air conditioning inner space can be connected respectively to the suction inlet 210 and the discharge outlet 170.

Also, inside an appearance case such as the side panel 130 or the rear panel 140, an adiabatic member 380 for shielding heat from an exterior may be further provided. In case the adiabatic member 380 is further installed, an adiabatic member fixing guide 382 for closing contacting the adiabatic member 380 with an inner surface of the panels 130, 140 may be further installed at a center portion.

Hereinafter, operation and interaction of the indoor unit for an air conditioner with the aforementioned construction will be described.

Figure 13:
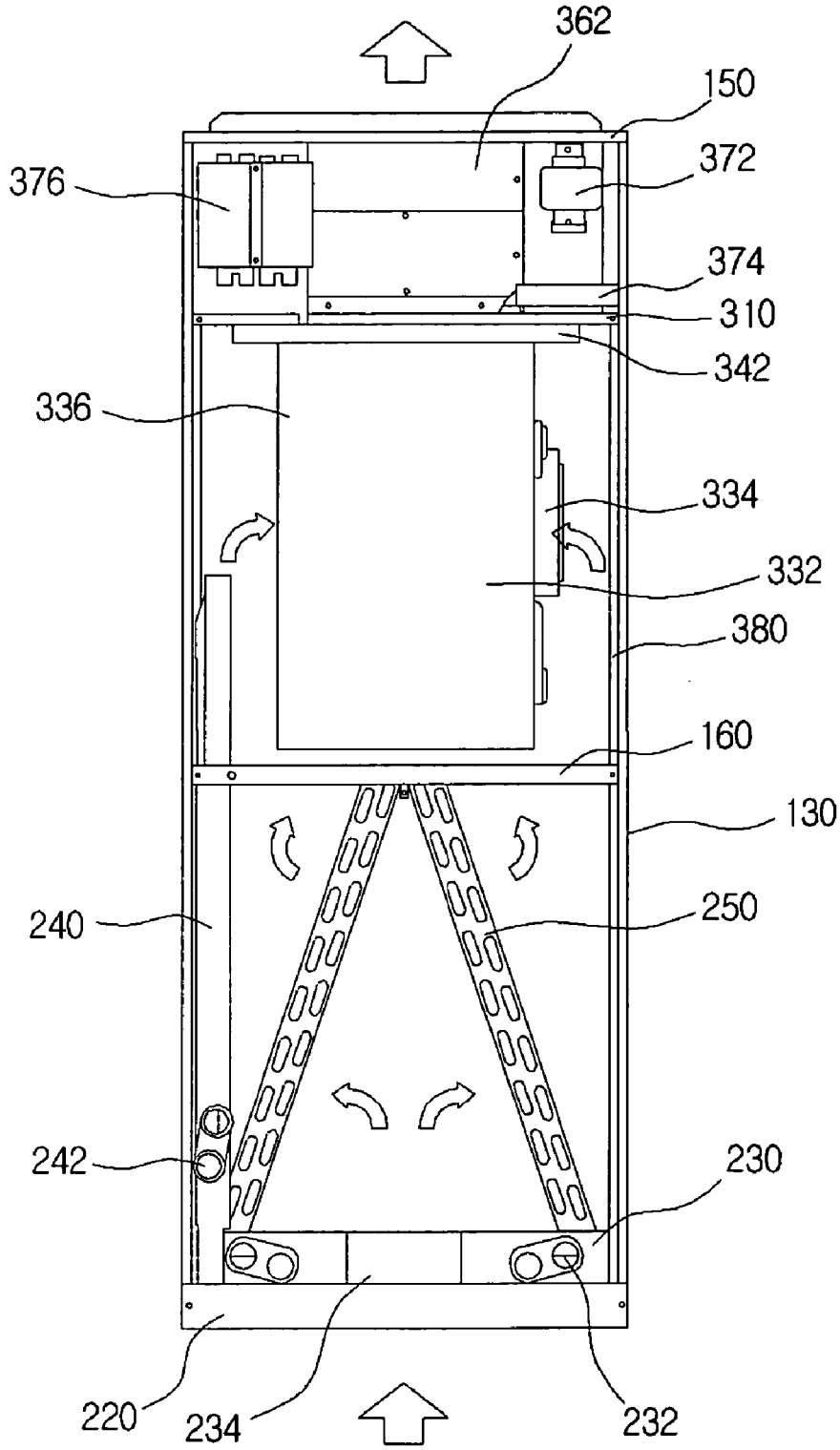
FIG. 13 illustrate that an indoor unit for an air conditioner according to the present invention is used in a straight standing state.
Figure 14:
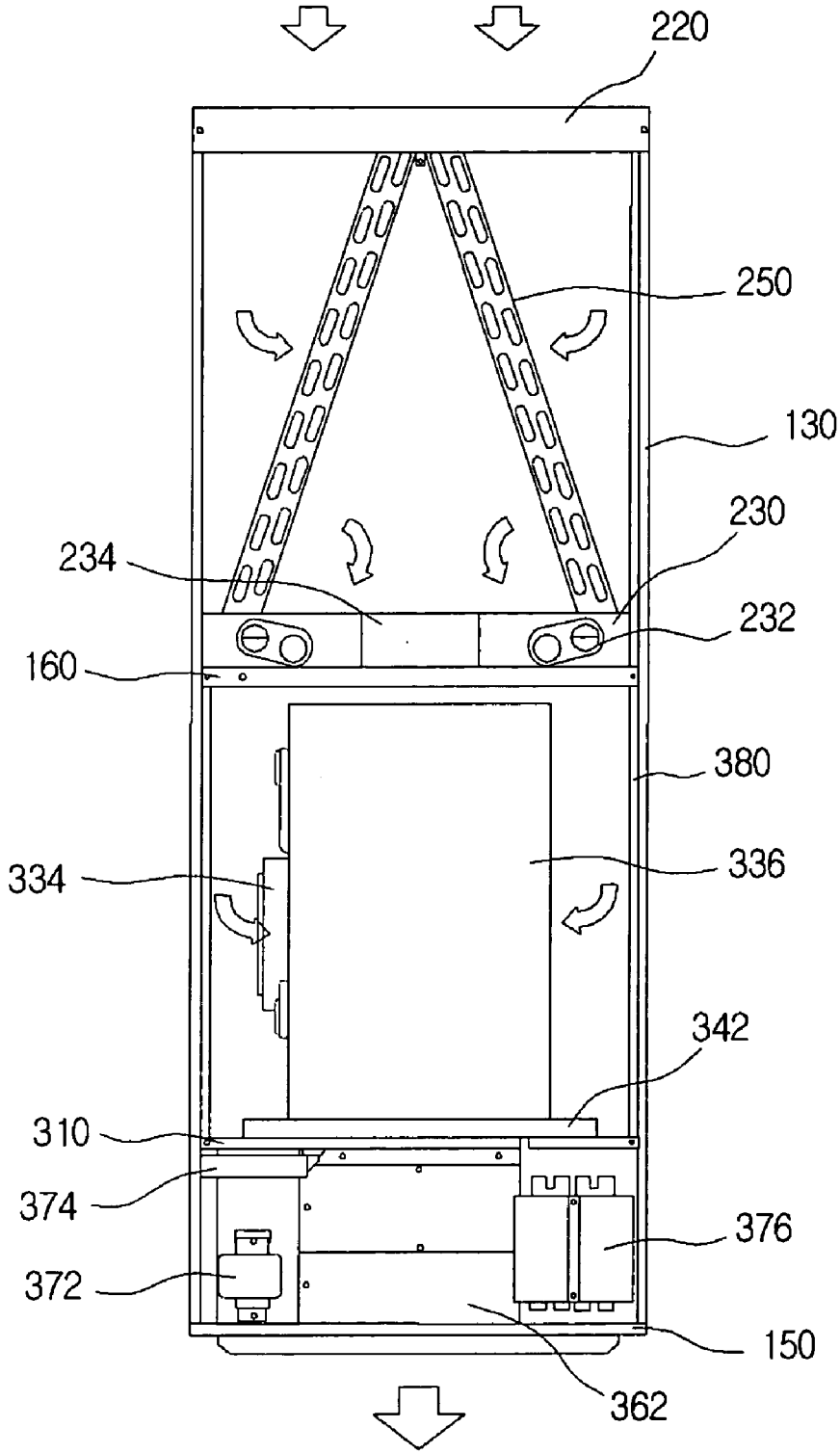
FIG. 14 illustrate that an indoor unit for an air conditioner according to the present invention is used in a standing state on its head.

FIG. 13 illustrate that an indoor unit for an air conditioner according to the present invention is used in a straight standing state, and FIG. 14 illustrate that an indoor unit for an air conditioner according to the present invention is used in a standing state on its head.

Referring to FIGS. 13 and 14, the indoor unit of the present invention is used in a straight standing state as shown in FIG. 13. At this time, air is inflowed into the inside of the indoor unit 100 through the suction inlet 210 from a lower direction, and is discharged through the discharge outlet 170 formed at an upper side surface after air conditioning operation is completed.

In detail, if the indoor fan 322 is rotated by a power applied from an exterior, a suction power is generated and thereby external air is inhaled into the indoor unit 100 through the suction inlet 210. Foreign particles contained in the air inflowed into the indoor unit 100 through the suction inlet 210 are filtered through the air filter (see numeral 222 of FIG. 3) and the filtered air exchanges heat while passing through the heat exchanger 250. In other words, when the air conditioner according to the present invention operates in a cooling mode, the indoor heat exchanger 250 functions as an evaporator so that heat of the air inhaled through the suction inlet 210 is taken away from refrigerant flowing through the indoor heat exchanger 250. Of course, if the indoor heat exchanger 250 is used as a condenser, inhaled air may be heated.

In the meanwhile, when heat is exchanged through the indoor heat exchanger 250, a difference in temperature causes condensed water to be generated in the indoor heat exchanger 250. The generated condensed water flows down due to gravity and is collected in the drain pan 230. The condensed water dropped in the drain pan 230 is transferred to the front end thereof and is then drained to an exterior of the indoor unit 100 through the drain part 232.

Hereinafter, draining operation of condensed water by the drain pan 230 will be described in detail. The condensed water condensed in the indoor heat exchanger 250 flows down owing to weight of itself. Specifically, the condensed water flows down to the side bottom surface 235 via the first and second inclined surfaces 278. Then, the condensed water is naturally transferred to the front end because the side bottom surface 235 is inclined forward, and is drained to an exterior of the indoor unit 100 through the drain part 232. Also, the front bottom surface 271 and the rear bottom surface 272 are inclined toward both directions from the center portion of the left and right direction, the condensed water smoothly flows down toward the depressed part 279. Also, since the bottom surfaces of both the corner portions of the front end part 231 are inclined in the direction of the depressed part 279, the condensed water dropped from the corner portions easily flows down toward the inward direction and is drained to the front side through the drain part 232.

When condensed water is drained through the drain part 232, the condensed water is drained first through the main drain part 273 because the main drain part 273 is leveled lower than the auxiliary drain part 274. Meanwhile, if the condensed water is not drained smoothly only through the main drain part 273 and the water level of the condensed water is elevated higher than the shield jaw 274, the condensed water is drained even through the auxiliary drain part 274. Hence, there disappears anxiety about leakage of condensed water.

The air whose heat is taken away while passing through the indoor heat exchanger 250 is introduced into the indoor fan 332 through a side direction of the fan housing 336, and is then discharged in a circumferential direction. The air discharged in the circumferential direction by the indoor fan 332 is guided by the fan housing 336 and is then discharged upward through the discharge hole 340. The air discharged through the discharge hole 340 of the fan housing 336 is discharged to an exterior through the discharge outlet 170 formed by the discharge guide member 350 and the vertical guide part 320 of the upper frame 300. Of course, although not shown in the drawings, a separate connection duct may be further installed between the discharge outlet 170 and an air conditioning space to guide air.

Also, although not shown in the drawings, while the indoor unit 100 is operated as above, an outdoor heat exchanger of an outdoor unit installed at a separate space functions as a condenser. Accordingly, since the refrigerant inside the outdoor heat exchanger discharges heat to the atmosphere, parts of the indoor unit 100 and the outdoor unit form a cycle.

Next, there will be described a case where the indoor unit 100 is used as a heat pump for heating. At this time, the flow direction of the refrigerant (working fluid) flowing through the indoor heat exchanger 250 is changed to an opposite direction, thereby allowing the indoor heat exchanger 250 to function as an condenser, or the electric heater 360 is operated to heat air with ease. Since the operation of the indoor heat exchanger 250 as a heat pump is possible only if the flow direction of refrigerant is made in an opposite direction, their detailed description is omitted and heating using the electric heater 360 will be described.

Exterior air (air conditioning space) is inflowed into the indoor unit 100 through the suction hole 210 by rotation of the indoor fan 332, and then passes through the indoor heat exchanger 250. At this time, since the indoor heat exchanger 250 is in a non-operation state, heat is not exchanged so that inhaled air moves upward, and is inflowed into the indoor fan 332 through the side direction of the fan housing 336. Air forcibly blown by the indoor fan 332 is guided upward by the fan housing 336 to pass through the inside of the discharge guide member 350.

At this time, since the electric heater 360 is heated by an external power, the air passing through the discharge guide member 350 is heated by the electric heater so that the hot air is discharged to the indoor space through the discharge outlet 170. As a result, heating of the indoor space is realized. Especially, the electric heater 360 can be used in convenience in an initial operation stage that requests a rapid heating.

In the meanwhile, the indoor unit constructed as above may be installed in a standing state on its head if necessary. In case the indoor unit is installed in a standing state on its head, it is necessary to change the installation state of the indoor heat exchanger 250 and the drain pan 230 so as to process the condensed water generated in the indoor heat exchanger 250.

In detail, as shown in FIG. 14, after the indoor heat exchanger 250 and the drain pan 230 that are installed at the lower side of the indoor unit 100 are drawn forward and separated, the indoor unit 100 is stood on its head, and the indoor heat exchanger 250 and the drain pan 230 are mounted on the middle frame 260. The front lower panel 120 is also separated and is installed standing on its head like the indoor heat exchanger 250. By doing so, the drain part 232 of the drain pan 230 is exposed to an exterior through the drain hole 124 of the front lower panel 120 like the case where the indoor unit 100 stands straight.

In the meanwhile, as aforementioned, in case the drain pan 230 and the indoor heat exchanger 250 are mounted on the middle frame 260, the rear end of the drain pan 230 is placed on the front end of the middle frame 260 and the drain pan 230 is pushed rearward so that both ends of the drain pan 230 are slid with placed on the upper surface of the pan guide 256, pushed rearward and equipped.

Figure 15:
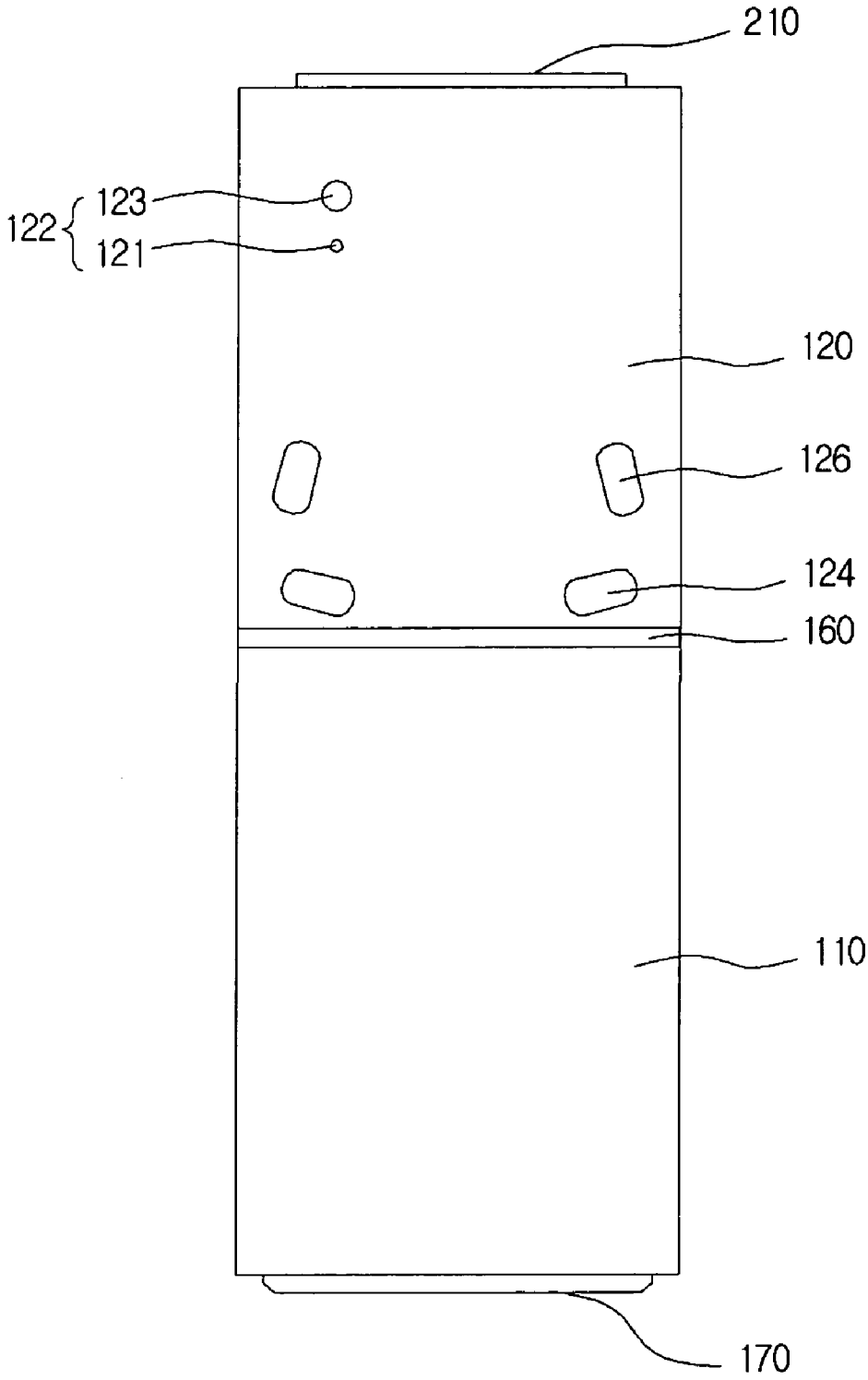
FIG. 15 is a front view of an indoor unit when the indoor unit stands straight.

Thus, in a state where the indoor heat exchanger 250 and the drain pan 230 are installed standing on their heads, a state of the front panel 110, 120 is illustrated in a front view of FIG. 15.

Reviewing the operation state in this state, the indoor fan 322 is first rotated by application of an external power like the straight standing installation.

As the indoor fan 332 rotates, external air is inhaled from an upper side into the indoor unit 100. The air inhaled through the suction hole 210 exchanges heat with inner refrigerant while passing through the indoor heat exchanger 250 so that it is changed to cool air.

At this time, condensed water is generated on the surface of the indoor heat exchanger 250 in the course of heat exchange, and the generated condensed water is collected in the drain pan 230 formed below and integrally with the indoor heat exchanger 250. Accordingly, the condensed water staying in the drain pan 230 can be drained to the outside through the drain part 232 formed at the front end thereof.

Also, the air passing through the indoor heat exchanger 250 is moved downward and introduced into the inside of the indoor fan 332 through the side portion of the fan housing 336. The air introduced into the inside of the indoor fan 332 is discharged in a circumferential direction and exhausted downward through the discharge outlet 170. A connection duct (not shown) may be further installed in the discharge outlet 170. This connection duct may guide the air discharged through the discharge outlet 170 to an air conditioning space.

Figure 16:
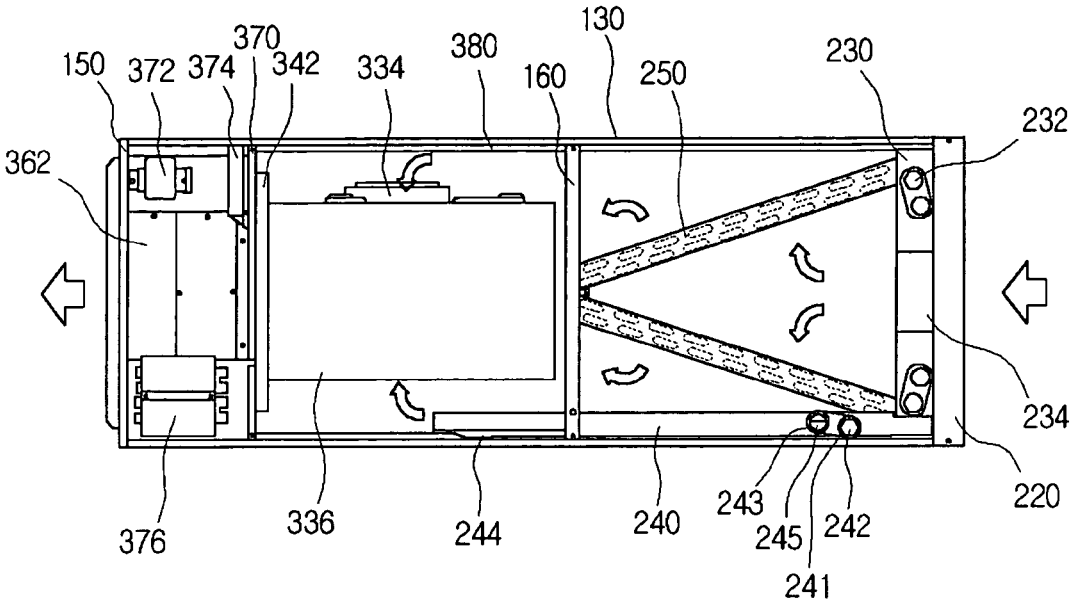
FIG. 16 illustrates a state that an indoor unit for an air conditioner according to the present invention is used in a lying state.

FIG. 16 illustrates a state that an indoor unit for an air conditioner according to the present invention is used in a lying state.

Referring to FIG. 16, the air flow is the same as that in the straight standing state or in the standing state on its head. It should be, however, understood that in FIG. 16, condensed water is drained by the side drain pan 240 instead of the drain pan 230. So, only the drainage operation of condensed water will be described.

Condensed water dropped to the side drain pan 240 is transferred to the front end and is then drained to an exterior of the indoor unit 100 through the side drain part 242.

At this time, because the side main drain part 241 is disposed lower than the side auxiliary drain part 243, condensed water is drained through the side main drain part 241. If the condensed water is not drained smoothly only through the side main drain part 241 and the water level of the condensed water is leveled higher than the side shield jaw 245, the condensed water is drained even through the side auxiliary drain part 243.

Also, since the support leg 246 is formed at a lower left side end of the side drain pan 240, the condensed water collected on the upper surface of the side drain pan 240 flows down to the right end and is easily drained through the side drain part 242. Since the auxiliary leg 248 is further coupled to the support leg 246 located rear, the side drain pan 240 is further inclined toward the front side. Accordingly, the condensed water on the side drain pan 240 can be easily drained to the front side. Also, as described previously, it is natural that the strength of the side drain pan 240 may be reinforced by the reinforcing rib 244 and the height level of the side drain pan 240 in the left and right direction can be different.

According to the proposed present invention, in any of cases where the indoor unit is installed in a straight standing state, in a standing state on its head, or in a lying state, condensed water generated in the heat exchanger can be drained to the outside conveniently. In other words, by the spirit of the present invention, since the drain pan is always positioned at a place adjacent to the indoor heat exchanger, the condensed water dropped by gravity can be drained to the outside conveniently.

Also, In addition, since users can mount or separate the drain pan in a sliding manner, users' convenience is further improved.

In addition, since the side bottom surface formed on the side end part of the drain pan is inclined forward, drainage of condensed water is smooth. Further, since the inclined bottom surface is further formed on the front end part of the side bottom surface to generate a height difference, even when the drain hose is connected to the drain part, the staying phenomenon of condensed water due to the thickness of the drain hose is prevented. As a result, contamination of the drain pan that may be caused by the staying of condensed water is prevented to provide users with pleasant life environment.

Moreover, since a pair of main drain parts and a pair of auxiliary drain parts are formed at the front end of the drain pan and the condensed water which is not still drained to the main drain part, is drained through the auxiliary drain part, drainage of condensed water is more smoothly performed. Also, even when one of the drain parts is closed, the condensed water can be drained with reliability.

What is claimed is:

1. An indoor unit for an air conditioner, comprising:

a heat exchanger for performing heat exchange;

a first drain pan for collecting and draining condensed water generated in the heat exchanger at a lower side of the heat exchanger;

two or more drains formed in the first drain pan and through which the condensed water is drained; and a second drain pan for collecting and draining condensed water generated in the heat exchanger at a side portion of the heat exchanger.

2. The indoor unit according to claim 1, wherein the drains comprise: a main drain formed at one side of the first drain pan; and an auxiliary drain formed at a higher height than the main drain.

3. The indoor unit according to claim 1, wherein each of the drains comprises a pair of drain parts formed independently, one of the pair of drains being provided with a shield jaw for shielding a drain in a horizontal direction.

4. The indoor unit according to claim 1, wherein each of the drains comprises two pairs of drain parts respectively formed at left and right sides of the first drain pan.

5. An indoor unit for an air conditioner, comprising:

a heat exchanger;

a drain pan for collecting and draining condensed water generated in the heat exchanger;

a drain part formed in the drain pan and through which the condensed water is drained; and an inclined surface formed at a bottom surface of the drain pan, wherein the bottom surface of the drain pan comprises a plurality of inclined surfaces.

6. The indoor unit according to claim 5, wherein the bottom surface of the drain pan is inclined downward toward the drain part.

7. The indoor unit according to claim 5, wherein the drain pan comprises an inclined surface extending from both sides of the drain pan to an inner portion and to which the condensed water is dropped and drained.

8. The indoor unit according to claim 5, wherein the drain pan comprises a second inclined surface extending from a second side of the drain pan to the inner portion and having a plurality of inclined protrusions for guiding flow of the condensed water.

9. The indoor unit according to claim 5, wherein the drain pan comprises inclined surface formed at an inner portion of a corner of the drain pan and having a multistep incline, for guiding flow of the condensed water.

10. The indoor unit according to claim 5, wherein the drain pan comprises a second inclined surface extending from a second side of the drain pan to the inner portion and having a inclined protrusion inclined in a left and right direction, for guiding flow of the condensed water.

11. The indoor unit according to claim 5, further comprising:

a plurality of inclined surfaces formed successively at an inner portion of a corner of the drain pan; and an inclined protrusion formed across each inclined surface.

12. The indoor unit according to claim 5, wherein the bottom surface of the drain pan is inclined such that left and right sides thereof are at a lower level than other portions with respect to a front and rear direction.

13. The indoor unit according to claim 5, wherein the front end of the drain pan has a corner portion, which is at a higher level than the drain part.

14. The indoor unit according to claim 5, wherein the drain pan comprises a bottom surface meeting the drain part, the bottom surface having a depressed portion.

15. The indoor unit according to claim 5, wherein the drain pan comprises a suction edge for enhancing the strength of the drain pan, the suction edge being formed with a side surface adjacent to a drain suction hole which is open at a center portion of the drain pan.

16. The indoor unit according to claim 5, wherein the drain pan comprises a bottom surface that has a width which decreases in the direction of the drain part.

17. An indoor unit for an air conditioner, comprising:

an indoor heat exchanger;

a lower drain pan for collecting and draining condensed water generated in the indoor heat exchanger at a lower side of the indoor heat exchanger;

a side drain pan for collecting and draining condensed water generated in the indoor heat exchanger at a side portion of the indoor heat exchanger; and a drain part formed in the lower drain pan and/or the side drain pan and through which the condensed water is drained.

18. The indoor unit according to claim 17, wherein the side drain pan comprises at least one rib formed on an outer bottom surface thereof.

19. The indoor unit according to claim 17, wherein the side drain pan comprises at least one support leg formed on an outer bottom surface thereof.

20. The indoor unit according to claim 17, further comprising two or more drain parts formed at a lower position of the side draining pan.

21. The indoor unit according to claim 17, wherein the drain part further comprises:

a main drain part formed at one side of the side drain pan; and an auxiliary drain part formed at a higher height than the main drain part.

22. The indoor unit according to claim 17, further comprising:

two or more drain parts formed at one side of the side drain pan; and a shield jaw formed at any one of the two or more drain parts, for selectively shielding the condensed water.

23. An indoor unit for an air conditioner, comprising:

a heat exchanger;

a drain pan for collecting and draining condensed water generated in the heat exchanger;

two or more drain parts formed in the drain pan and through which the condensed water is drained; and a front panel provided with a drain hole through which the drain part is penetrated, the front panel having a varied installation position.

* * * * *